United States Patent [19]

Vagedes et al.

[11] Patent Number: 4,726,152

[45] Date of Patent: Feb. 23, 1988

[54] BRACKET FOR MOUNTING A FIXTURE ON A WALL

[75] Inventors: Michael J. Vagedes, Florence; Douglas R. Vagedes, Erlanger, both of Ky.

[73] Assignee: Vagedes Industries, Inc., Elsmere, Ky.

[21] Appl. No.: 934,503

[22] Filed: Nov. 24, 1986

[51] Int. Cl.[4] ..... E04H 14/00

[52] U.S. Cl. ..... 52/28; 52/211; 362/147; 248/300

[58] Field of Search ..... 52/28, 173, 211, 212, 52/518; 248/205.1, 217.4, 300; 362/145, 147

[56] References Cited

U.S. PATENT DOCUMENTS

| | | | |
|---|---|---|---|
| 1,484,001 | 2/1974 | Ainsworth | 248/300 |
| 2,494,428 | 1/1950 | Buck | 362/147 X |
| 3,315,924 | 4/1967 | Greenwood | 248/300 X |
| 3,500,600 | 3/1970 | Bagley, Sr. | 52/211 |
| 4,156,272 | 5/1979 | Wandler | 362/147 X |
| 4,245,284 | 1/1981 | Moore et al. | 362/370 X |
| 4,472,768 | 9/1984 | Quiogue | 362/432 X |
| 4,635,168 | 1/1987 | Crowley | 362/147 |

*Primary Examiner*—Carl D. Friedman
*Assistant Examiner*—Creighton Smith
*Attorney, Agent, or Firm*—James W. Pearce; Roy F. Schaeperklaus

[57] ABSTRACT

A bracket for mounting a fixture on a wall of a building. The bracket includes a hollow neck structure. At one end of the neck structure is flange means which is mounted on sheathing of the wall. The other end of the neck structure is closed by a main plate. An edge portion of the main plate extends outwardly of the neck structure spaced from the flange means to form an annular socket in which edge portions of siding of the wall terminate. The fixture can be mounted on the main plate, and access to the fixture can be had through an opening in the main plate.

5 Claims, 8 Drawing Figures

BRACKET FOR MOUNTING A FIXTURE ON A WALL

BACKGROUND OF THE INVENTION

This invention relates to a bracket for mounting a fixture on a wall. More particularly, this invention relates to a bracket which can be supported on sheathing of a building which overlies and protects edges of siding.

Siding of a building ordinarily is not strong enough to support an electrical or plumbing fixture or the like. An object of this invention is to provide a bracket which can be mounted on sheathing of the building and protects edges of siding surrounding the bracket.

SUMMARY OF THE INVENTION

Briefly, this invention provides a bracket having a main plate portion, an annular support portion spaced inwardly of an outer edge of the main portion, and a flat annular flange on the support portion. Slot means is provided in the flat annular flange for mounting the bracket on the sheathing or on frames which support the sheathing. The main plate portion is supported in spaced relation to the sheathing. An opening can be formed in the main plate portion to give access to a fixture mounted on the main plate portion.

The above and other objects and features of the invention will be apparent to those skilled in the art to which this invention pertains from the following detailed description and the drawings, in which:

BRIEF DESCRIPTION OF THE DRAWINGS

In the following detailed description and the drawings, like reference characters indicate like parts.

DESCRIPTION OF THE PRESENTLY PREFERRED EMBODIMENT

Figure 1:
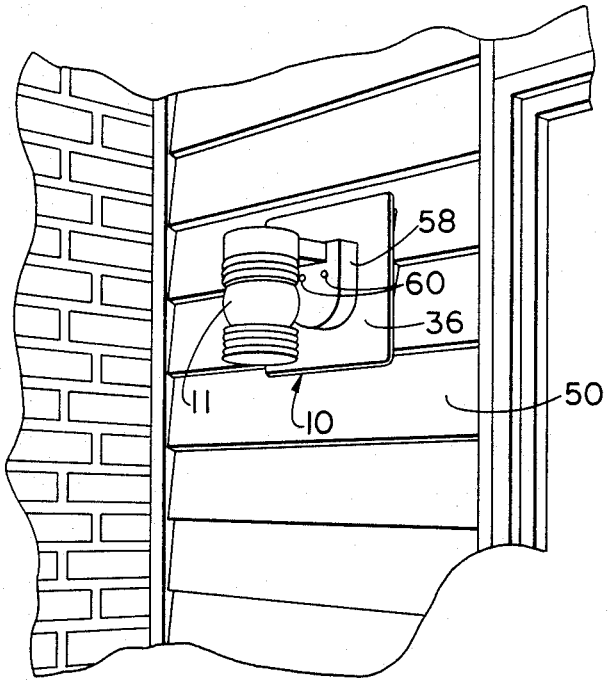
FIG. 1 is a fragmentary perspective view of a portion of a house on which is mounted a bracket constructed in accordance with an embodiment of this invention, a fixture being shown on the bracket.

In the drawings is shown a bracket 10 for mounting a fixture 11 on a wall which is constructed in accordance with an embodiment of this invention. The bracket 10 includes a base member 12 and a cap member 14. The base member 12 is of angle shape in section and includes an upper main flange 16, a lower main flange 18, and side main flanges 20 and 21. The main flanges 16, 18, 20 and 21 form an annular neck structure defining a rectangular opening 22. An upper coplanar flange 24, a lower coplanar flange 26 and side coplanar flanges 28 and 29 extend outwardly from the main flanges and can engage flatwise against a sheathing panel 30.

Slots 32 are formed in the upper coplanar flanges 24 and the lower coplanar flange 26 for receiving nails 33 which fasten the base member 12 to a frame stud 34, which can also support the sheathing panel 30.

The cap member 14 includes a main plate portion 36 and an annular neck portion 38. The neck portion 38 includes an upper plate portion 38A, a lower plate portion 38B and side plate portions 38C and 38D. The neck portion 38 fits snugly inside the main flanges of the base member 12. Rivets 40, 41, 42 and 43 lock the neck portion 38 in position inside the main flanges of the base member 12. A flange section 44 of the main plate portion 36 projects outwardly beyond the main flanges 16, 18, 20 and 21 of the base member 12. A space outboard of the main flanges 16, 18, 20, and 21 of the base member 12 and between the coplanar flanges 24, 26, 28, and 29 and the flange section 44 of the main plate portion 36 of the cap member 14 forms an outwardly directed socket for receiving edge portions of the siding panel means.

Figure 2:
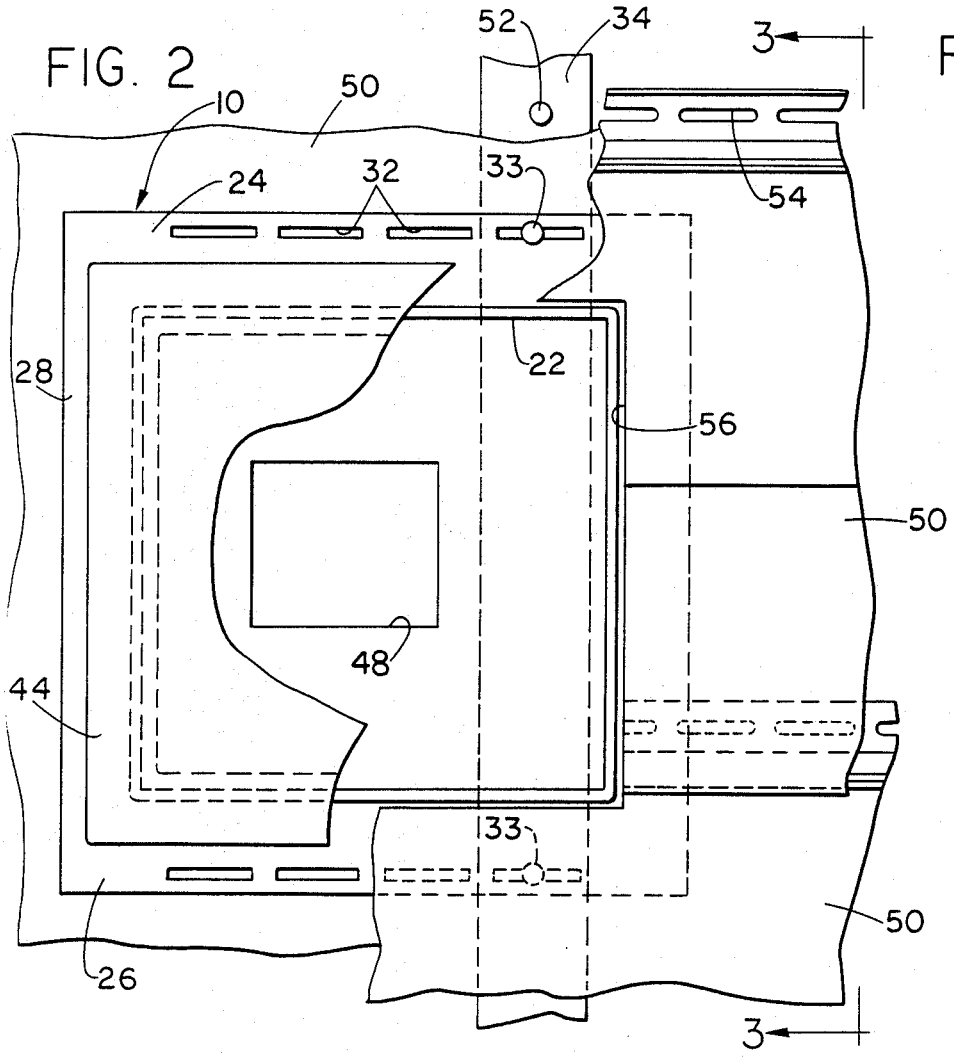
FIG. 2 is a fragmentary view in side elevation showing a section of sheathing, a frame for supporting the sheathing, a fragmentary portion of siding, and the bracket illustrated in FIG. 1 with the fixture being removed.
Figure 3:
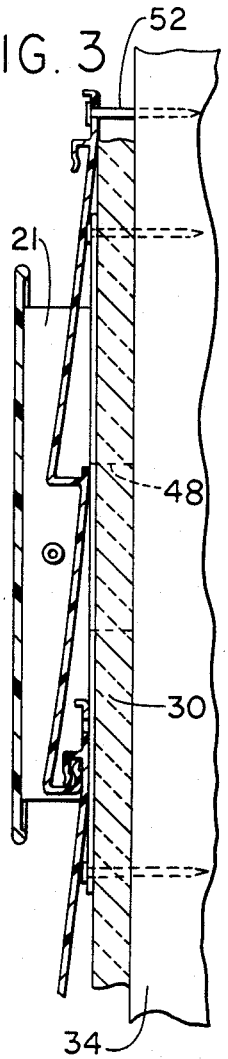
FIG. 3 is a view in section taken generally on the line 3—3 in FIG. 2, an edge flange of a cap member being broken away to show details of structure.
Figure 4:
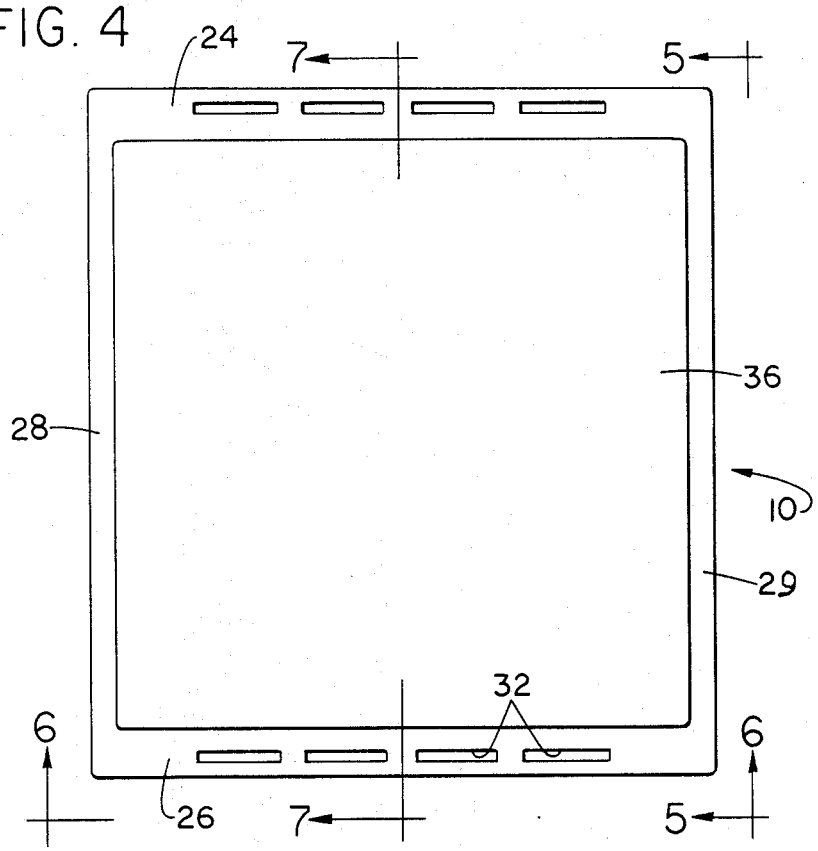
FIG. 4 is a view in front elevation of the bracket.
Figure 5:
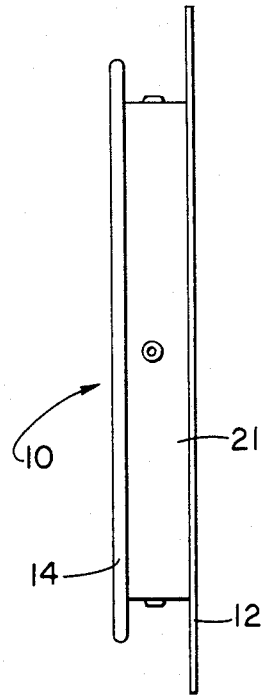
FIG. 5 is a view in side elevation looking in the direction of the arrows 5—5 in FIG. 4.
Figure 6:
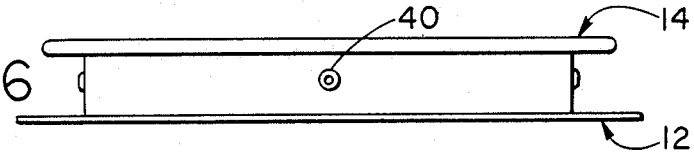
FIG. 6 is a view in bottom plan of the bracket looking in the direction of the arrows 6—6 in FIG. 4.
Figure 7:
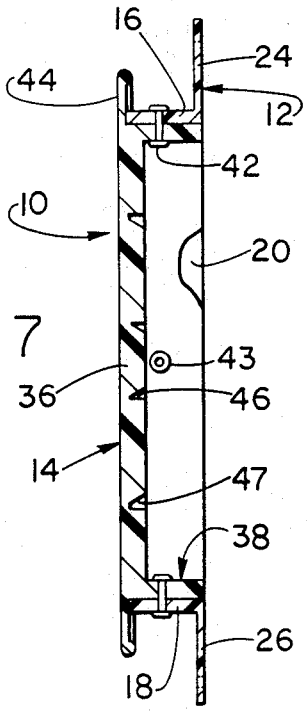
FIG. 7 is a view in section taken on the line 7—7 in FIG. 4.
Figure 8:
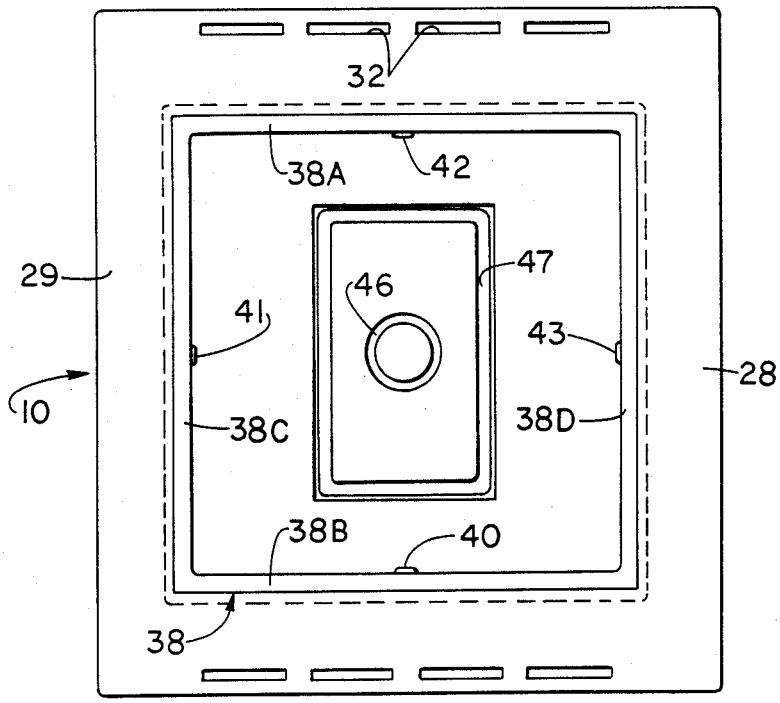
FIG. 8 is a view in rear elevation of the bracket.

The main plate portion 36 is provided with a central circular line of weakening 46 and a rectangular line of weakening 47. Portions inside the lines of weakening can be removed to permit access between sides of the main plate portion 36. Access through the sheathing panel 30 can be had through an appropriate opening in the sheathing panel 30 as indicated at 48 in FIG. 2.

The bracket 10 is mounted on the sheathing panel 30 by means of the nails 33, which extend through the sheathing panel into the frame stud 34, with the opening 48 in the sheathing panel 30 aligned with the bracket 10. Siding panels 50 can be attached to the sheathing panel 30 by nails 52 which extend through slots 54 in the siding panels 50 and with edges 56 of the siding panels at the bracket 10 terminating between the flange 44 of the cap member 14 and the coplanar flanges 24, 26, 28 and 29 so that the edges of the siding panels 50 are protected. A portion of the main plate portion 36 of the cap member 14 is removed at one of the lines of weakening 46 and 47, and the fixture 11 is mounted on the main plate portion 36. Appropriate fasteners 60 can attach the fixture 11 to the main plate portion 36. The main plate portion 36 forms a smooth surface on which the fixture 11 can be mounted. The opening 48 in the sheathing and the openings which can be formed at the lines of weakening 46 and 47 provide access between the interior of the sheathing and the interior of the fixture.

The bracket 10 can be used to mount various types of fixtures such as electric fixtures and plumbing fixtures.

The bracket 10 illustrated in the drawings and described above is subject to structural modification without departing from the spirit and scope of the appended claims.

Having described our invention, what we claim as new and desire to secure by Letters Patent is:

1. In a combination with a wall of a building including a framework, sheathing mounted on the framework, and siding panel means mounted on the sheathing and on the framework, a bracket overlying the sheathing, the bracket including a neck structure defining an opening, flange means at an end of the neck structure extending outwardly therefrom and engaging the sheathing flatwise, a main plate mounted at an opposed end of the neck structure, an edge portion of the main plate extending outwardly from the neck structure and spaced from the flange means to form an outwardly directed socket, edge portions of the siding terminating in the socket, means for attaching the bracket to the framework, and means for mounting a fixture on the main plate.

2. In combination with a wall of a building including a framework, sheathing mounted on the framework, siding panel means mounted on the sheathing and on the framework, a bracket overlying the sheathing, the bracket including a neck structure defining an opening, flange means at an end of the neck structure extending outwardly therefrom and engaging the sheathing flatwise, a main plate mounted at an opposed end of the neck structure, an edge portion of the main plate extending outwardly from the neck structure and spaced from the flange means to form an outwardly directed socket, the neck structure being substantially rectangular, sides of the neck structure being parallel to and at right angles to the siding panel means, edge portions of the siding terminating in the socket, means for attaching the bracket to the framework, and means for mounting a fixture on the main plate.

3. In combination with a wall of a building including a framework, sheathing mounted on the framework, siding panel means mounted on the sheathing and on the framework, a bracket overlying the sheathing, the bracket including a neck structure defining an opening, flange means at an end of the neck structure extending outwardly therefrom and engaging the sheathing flatwise, a main plate mounted at an opposed end of the neck structure, an edge portion of the main plate extending outwardly from the neck structure and spaced from the flange means to form an outwardly directed socket, means for mounting a fixture on the main plate, an opening being provided through the main plate underlying the fixture, an opening being provided through the sheathing underlying the bracket to provide access between the interior of the sheathing and the interior of the fixture, edge portions of the siding terminating in the socket, and means for attaching the bracket to the framework.

4. In combination with a wall of a building including a framework, sheathing mounted on the framework, siding panel means mounted on the sheating and on the framework, a bracket overlying the sheathing, the bracket including a neck structure defining an opening, flange means at an end of the neck structure extending outwardly therefrom and engaging the sheathing flatwise, a main plate mounted at an opposed end of the neck structure, an edge portion of the main plate extending outwardly from the neck structure and spaced from the flange means to form an outwardly directed socket, the bracket including a base member and a cap member, the cap member including a first neck structure and the main plate, the base member including a second neck structure and the flange means, means for attaching the neck structures together in telescopic relation to hold the base member and the cap member in assembled relation, edge portions of the siding terminating in the socket, means for attaching the bracket to the framework, and means for mounting a fixture on the main plate.

5. A bracket for mounting a fixture on a wall which includes sheathing and siding panel means which comprises a cap member and a base member, the cap member including a first neck structure and a main plate mounted on the first neck structure, the base member including a second neck structure and flange means at one end of the second neck structure, the flange means fitting flatwise against the sheathing, an edge portion of the main plate extending outwardly from the neck structures and spaced from the flange means to form an outwardly directed socket for receiving edge portions of the siding panel means and means for attaching the neck structures together in telescopic relation.

* * * * *

UNITED STATES PATENT AND TRADEMARK OFFICE

CERTIFICATE OF CORRECTION

PATENT NO. : 4,726,152

DATED : February 23, 1988

INVENTOR(S) : Michael J. Vagedes and Douglas R. Vagedes

It is certified that error appears in the above-identified patent and that said Letters Patent are hereby corrected as shown below:

On the Title Page

[56] References Cited

U.S. PATENT DOCUMENTS

"1,484,001 2/1974 Ainsworth . . . . . 248/300"

should be:

- - 1,484,001 2/1924 Ainsworth . . . . . 248/300 - -.

Signed and Sealed this

Twelfth Day of July, 1988

*Attest:*

DONALD J. QUIGG

*Attesting Officer*

*Commissioner of Patents and Trademarks*